US006896576B1

(12) United States Patent
VanKuiken

(10) Patent No.: US 6,896,576 B1
(45) Date of Patent: May 24, 2005

(54) YO-YO WITH SHOCK SUPPRESSION SYSTEM

(76) Inventor: Jack C. VanKuiken, 2244 Ridgewood Rd., Lisle, IL (US) 60532

( * ) Notice: Subject to any disclaimer, the term of this patent is extended or adjusted under 35 U.S.C. 154(b) by 37 days.

(21) Appl. No.: 10/744,185

(22) Filed: Dec. 23, 2003

(51) Int. Cl.[7] ..... A63H 1/06; A63H 1/22
(52) U.S. Cl. ..... 446/247; 446/245
(58) Field of Search ..... 446/249, 250, 446/251, 252, 253, 254, 255, 245, 247, 248

(56) References Cited

U.S. PATENT DOCUMENTS

| | | | | |
|---|---|---|---|---|
| 60,961 | A | 1/1867 | Syrcher | |
| 3,081,578 | A | 3/1963 | Mosher | |
| 5,254,027 | A | 10/1993 | McAvoy, Jr. | |
| 5,389,029 | A | 2/1995 | McAvoy, Jr. | |
| 6,080,035 | A | 6/2000 | Pekarsky et al. | |
| 6,080,036 | A | 6/2000 | Adler | |
| 6,113,456 | A | 9/2000 | Hadzicki et al. | |
| 6,196,891 | B1 * | 3/2001 | Jamison | 446/250 |
| 6,206,749 | B1 | 3/2001 | Bell | |
| 6,220,920 | B1 | 4/2001 | Baier | |
| 6,254,452 | B1 | 7/2001 | Adler | |
| 6,579,142 | B1 | 6/2003 | Rehkemper et al. | |
| 6,599,165 | B1 * | 7/2003 | Van Dan Elzen | 446/250 |
| 6,652,345 | B1 * | 11/2003 | Lin | 446/15 |

OTHER PUBLICATIONS www.yoyojam.com/yoyos/, Yo YoJam Precision Yo Yos and Tops, Mini Motrixx, p. 2., accessed Nov. 19, 2003.
www.theyo.com/friction.html, Yo- Yo Response Systems and Stickers, YY Jam Matrixx O-ring, accessed Nov. 19, 2003.

* cited by examiner

*Primary Examiner*—Derris H. Banks
*Assistant Examiner*—Faye Francis
(74) *Attorney, Agent, or Firm*—Philip H. Kier

(57) ABSTRACT

A yo-yo wherein each half body has three essential elements: a axle/hub assembly, a rim, and an interior space containing flexible, compressible material, such as an elastomer or a bladder filled with gas, liquid, or gel. The axle/hub assembly and the rim contain the flexible, compressible material but are not rigidly in contact with each other. In this way a shock to the rim and vibrations to the string are suppressed and dampened by the flexible, compressible material. For greater flexibility and shock damping, there could be cavities (grooves or holes) in the elastomer material or for greater lateral stability, the rim could overlap the gaps between it and the axle/hub assembly. There could also be containment/alignment walls extending into the flexible, compressible material or O-rings in gaps between the rim and the axle/hub assembly.

6 Claims, 4 Drawing Sheets

YO-YO WITH SHOCK SUPPRESSION SYSTEM

BACKGROUND OF THE INVENTION

This invention pertains to yo-yos and can have potential application to other spinning toys such as tops, gyros, and flying discs. More particularly it pertains to a yo-yo with a shock suppression system to reduce the impact of the yo-yo as it returns to the player's hand.

Recently, designers of yo-yos have addressed the problem of potential pain and injury to a player's hand when the player catches a hard-bodied yo-yo on its return. A hard-bodied yo-yo with no shock suppression system can also cause injury to other body parts or damage to other objects upon collision. Adler in U.S. Pat. No. 6,254,452 teaches the use of elastomer cushions that are radially anchored to the outer perimeter of the bodies of the yo-yo. Pekarsky et al in U.S. Pat. No. 6,080,035 teaches use of yo-yo bodies having a hard hub member and a relatively resilient elastic rotor member that snaps on the hub member and provides a degree of shock suppression. McAvoy, Jr. in U.S. Pat. No. 5,389,029 teaches the use of body halves made of a resilient material such as polyurethane to cushion the hand from impact. Mosher in U.S. Pat. No. 3,081,578 describes a yo-yo/top combination that has annular bands of resilient material disposed on the periphery of the body halves to provide a cushioning effect. Rehkemper et al in U.S. Pat. No. 6,579,142 describes a modular yo-yo with a resilient rubberized outer ring to reduce discomfort to the user's hand when the yo-yo returns.

To summarize, the prior art patents that address shock suppression generally use cushioning devices located around the periphery of the yo-yo, requiring that the elastomer be either elastically attached or radially anchored to the hub or walls of the yo-yo. Elastically-attached cushions have drawbacks as identified by Adler[1]. To remain attached the cushions must be relatively hard or else they will tend to fly off the yo-yo or become unbalanced or off-centered at high spin rates owing to centrifugal forces. Even if they remain in position, deformations that occur can introduce unbalanced wobbles and unwanted vibrations in a spinning yo-yo. For radially-anchored cushions, and especially for soft cushions, there can still be deformations that create wobbles and unwanted vibrations. Also, designing a secure anchoring device without interfering with cushioning or without complicating manufacturing requirements can be very challenging.

In addition, yo-yos with cushions positioned at the outer periphery usually have high-friction surfaces that can interfere with yo-yo tricks. In practice, tricks like "walk the dog" are easier to maintain with a smooth low-friction outer surface that slides or skids along common flooring materials. Incidental contact with a player's clothing or nearby furniture that will otherwise grab and stop a high friction elastomer surface will not halt the spin of a smooth low friction yo-yo surface.

SUMMARY OF THE INVENTION

The novel feature of the present invention is that it has a shock-absorbing elastomer core positioned in the space between a rigid, smooth outer rim and a rigid axle/hub assembly. This cavity is not completely closed but rather has openings that allow movement of the axle/hub assembly relative to the rim during moments of impact. The elastomer core not only provides cushioning owing to flexing and movement of the axle/hub assembly relative to the rim at impact, but also provides positioning, centering, and alignment between the axle/hub assembly and the rim. Benefits for yo-yo play that result from this novel feature, in addition to shock reduction are: reduced string vibration (very quiet "sleep" properties); softer, cushioned impacts when errant tosses collide with hard objects; low friction on the outer rim surface; controllable degree of cushioning through simple core design options; possible enhancement of string gripping power in the return area; and excellent alignment of the yo-yo parts for smooth true center, on-axis spins even though portions of the yo-yo may be easily flexed. The combination of the elastomeric bounce capability and low friction outer surface make possible development of new tricks.

BRIEF DESCRIPTION OF THE SEVERAL VIEWS

FIG. 1 shows a cross section view of the basic embodiment of the invention with elastomer filling the interior space between the rim and axle/hub assembly.

FIG. 1*a* shows an exploded view of the embodiment shown in FIG. 1.

FIG. 2 shows a cross section view along plane 2—2 of FIG. 2*a* of an embodiment with cavities in the elastomer.

FIG. 2*a* shows a side view of an embodiment with both holes and grooves in the elastomer.

DETAILED DESCRIPTION OF THE INVENTION

Figure 1:
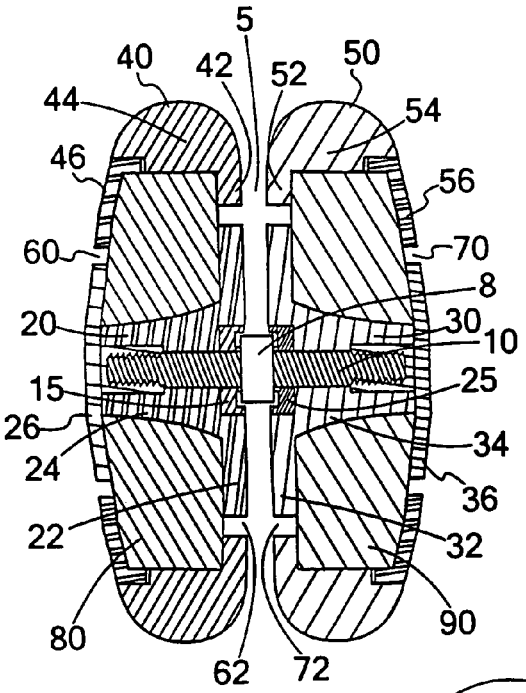

All the embodiments that are described in this section share essential structural characteristics. In all of them, a rim of a half body is separated from an axle/hub assembly and there is flexible, deformable material in the interior space between the rim and the axle/hub assembly. FIG. 1 shows a basic embodiment of the present invention. Because the invention is a yo-yo, its various elements are figures of revolution about a central axis. There are two half bodies, usually identical, joined by axle 10 and separated by string gap 5. Most modern yo-yos use a friction reduction device in conjunction with the axle. In the embodiment shown in the figures the friction reduction device is a bearing 8 surrounding the axle in the string gap, with spacers 15 and 25. The friction reduction device could also be bushings. The axle is centered in a hub, 20 and 30 within each half body. The axle could be threaded and the hubs could also be threaded to facilitate assembly, or as an alternative to having threaded hubs, there could be a nut in each hub. The hub in each half body has an inner section 22 and 32, a spindle 24 and 34, and an outer section 26 and 36. The inner section, which borders the string gap, has a greater diameter than the spindle. The outer section, which forms part of the outer surface of a half body, also has a greater diameter than the spindle.

Figure 1A:
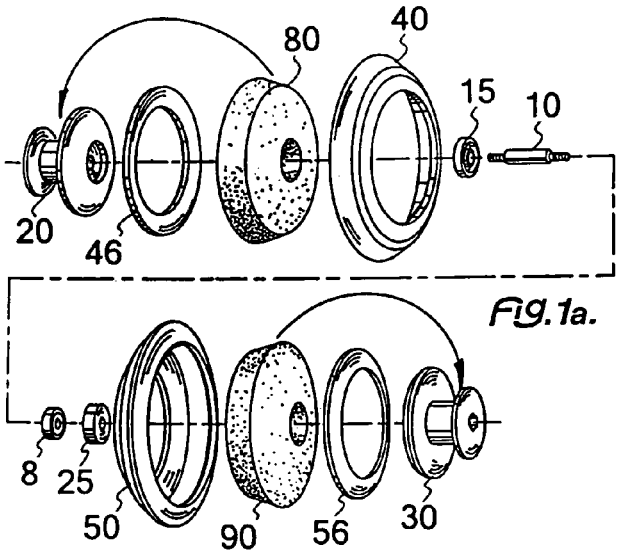

Each half body also has an annular rim 40 and 50, respectively, that is made of a smooth rigid material. Each rim has an inner section 42 and 52 that borders the string gap 5, an outer section 46 and 56 that forms part of the outer surface, and a cap 44 and 54 that is most likely to contact a surface when the yo-yo is in play. The inner section and the outer section of the rim of a half body extend closer to the axle than to the cap of the rim. The outer section of the rim does not contact the outer section of the hub so that there is a gap 60 and 70. Similarly, the inner section of the rim does not contact the inner section of the hub so that there is a gap 62 and 72. Because of the shapes of the rim and the hub there is interior space between the rim and hub that is open to the exterior of the yo-yo because of the gaps. In this embodiment the cavity is filled with an elastomer 80 and 90, so that the rim is in contact with the elastomer but not with the hub. The invention works well over a wide range of elastomer hardness. The elastomer could be a single piece or could be in layers to facilitate manufacture and fabrication. Also different layers could be different elastomer materials. The invention could be implemented with means for swapping alternate elastomer components to allow a player the ability to customize. The invention allows the rims to float and be cushioned relative to the axle/hub assembly. Should a rim sharply contact a player's hand or other surface, the resulting shock is absorbed by the elastomer and vibration is dampened. Furthermore, while the yo-yo is spinning, vibrations arising from the spinning motion that would normally be transmitted to the player's hand are also absorbed and dampened by the elastomer. An exploded view of this embodiment is shown in FIG. 1*a*.

The three sections of the rim could be molded as one integral piece, or the inner section and the cap could be molded as one piece and the outer section, or collar, as a separate piece that is attached during assembly. The integral one-piece option can offer simpler assembly if combined with injection molding of the elastomer; however, the mold required is more complex and expensive. Similarly the three sections of the hub could be molded as one integral piece, or the inner section and the spindle could be molded as one piece and the outer section as a separate piece that is attached during assembly. In addition to means for swapping alternative elastomer fillings, this invention could also include means to adjust the compression of contained elastomers to adjust flexibility and shock absorption characteristics. Such means could be accomplished by threaded engagement of the collar, 46 and 56 with the other rim components or by threaded engagement of the outer hub section 26 and 36 with the other hub components.

Figure 2:
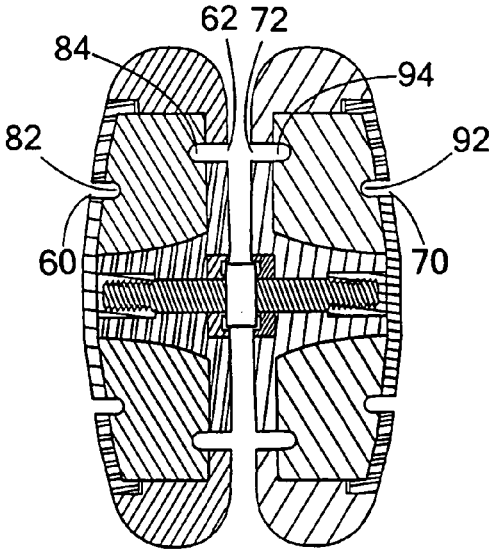
Figure 2A:
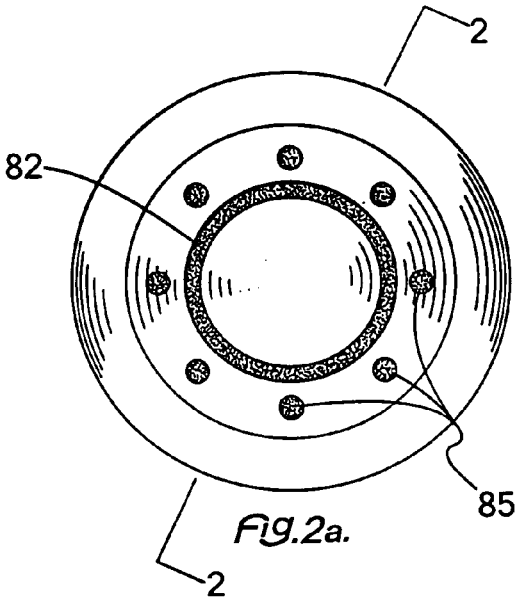

FIG. 2 shows an alternative embodiment with greater flexibility and shock absorption capability owing to cavities in the elastomer. In addition to increasing flexibility and shock absorption, the cavities also reduce the weight of the elastomer. The cavities could be holes or annular grooves, or both grooves and holes. In the embodiment shown, there are grooves 82 and 92 in the elastomer starting at outer gaps 60 and 70 and extending into the elastomer. There are also grooves 84 and 94 starting at inner gaps 62 and 72 and extending into the elastomer. Grooves need not be in alignment with the gaps but may be located at other positions in the elastomer. FIG. 2*a* shows an embodiment where there are holes, 85, in addition to grooves in the elastomer.

Figure 3:
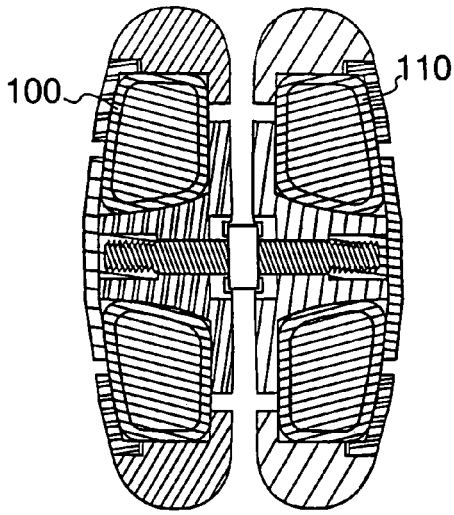
FIG. 3 shows a cross section view of an embodiment with filled bladders in the interior space between the rim and axle/hub assembly.

FIG. 3 shows an alternative embodiment in which the interior space of a half body between the rim and the hub contains a bladder 100 and 110 instead of an elastomer material. The bladder is filled with either a gas, liquid, sol, or gel to provide the flexibility that is provided by elastomer material in other embodiments. A plurality of bladders, as well as a single bladder, could be used. In embodiments with bladders, controlling the pressure of fill material allows variation in flexibility and shock absorption characteristics similar to using elastomers with different hardness in other embodiments. Valves can be included so that players can make adjustment in pressure and flexibility.

Figure 4:
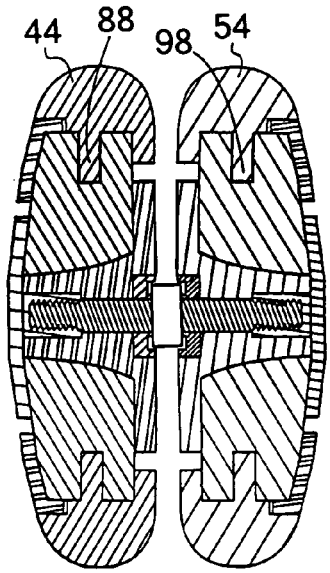
FIG. 4 shows a cross section view of an embodiment with a wall extending into the elastomer from the rim.

FIG. 4 shows an embodiment with a wall 88 and 98 extending inward from the cap of the rim 44 and 54 through part of the elastomer zone. This wall helps keep the yo-yo in alignment and also provides some lateral containment. There could also be a wall extending outward from the spindle of the hub 24 and 34. In embodiments with plural bladders in the half body, the wall, or walls could extend between bladders.

Figure 5:
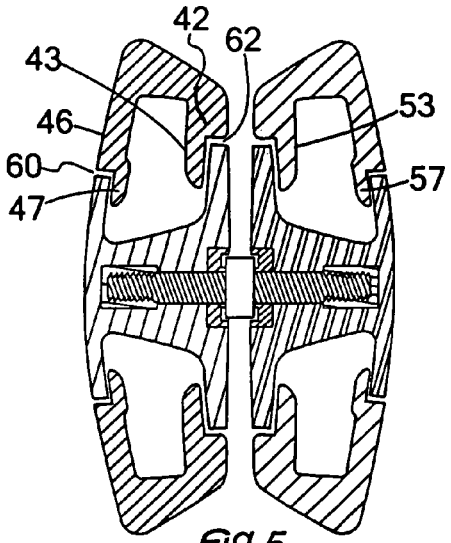
FIG. 5 shows a cross section view of an embodiment with overlapping side walls.

FIG. 5 shows an embodiment in which the inner section of the rim, 42 and 52 has an extension 43 and 53 that jogs outward (toward the center of a half body) and then extends beyond gap 62 and 72. Similarly the outer section of the rim 46 and 56 has an extension 47 and 57 that jogs inward and then extends beyond gap 60 and 70. This "overlap" embodiment also allows radial movement between the rim and the axle/hub assembly but provides for greater lateral stability.

Figure 7:
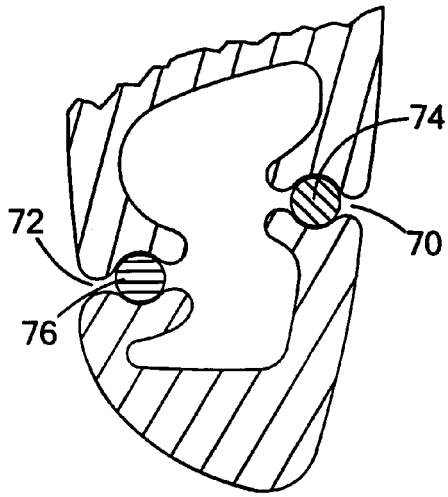
FIG. 7 shows a cross section view of the vicinity of an O-ring.
Figure 6:
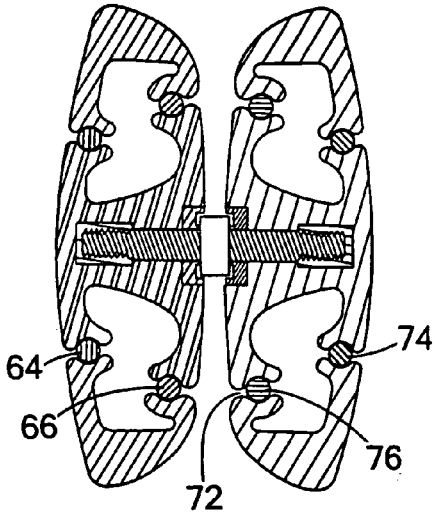
FIG. 6 shows a cross section view of an embodiment with O-rings in the gap between the rim and axle/hub assembly.

The embodiment, shown in FIG. 6 has an elastomer O-ring 64 and 74 in outer gap 60 and 70 and elastomer O-ring 66 and 76 in inner gap 62 and 72. In this embodiment, the end of the inner section of the rim and end of the inner section of the hub, and the end of the outer section of the rim and the outer section of the hub have a socket-like shape as shown in FIG. 7. As noted for the embodiment with cavities in an elastomer, the interior space of a half body need not be entirely filled with elastomer. This configuration has the advantage of reducing the weight of the elastomer used, because the interior space is not completely filled with elastomer, while providing lateral stability through the O-ring socket alignment. It can be noted that O-rings have been used to facilitate return of the yo-yo as a friction device that helps catch the string[2,3], and O-rings have been used to provide cushioning when used as the outer perimeter of yo-yos. However, O-rings have not been applied previously for cushioning between outer rim and hub as applied in this invention.

Figure 8:
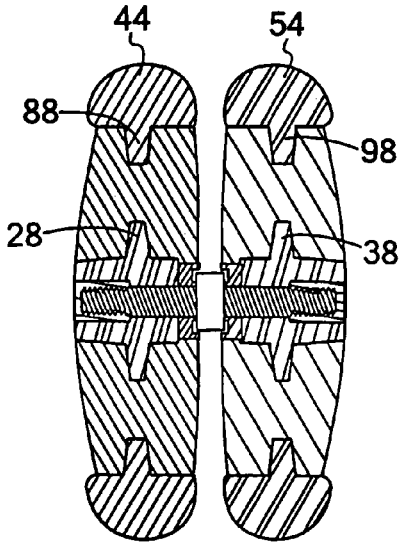
FIG. 8 shows a cross section view of an embodiment with interior walls extending into an elastomer but a rim and hub without outer walls.

In the embodiments discussed thus far, the hub and the rim have outer walls, the inner and outer sections, to provide lateral containment and stability. However, lateral containment, alignment, and stability can also be provided without outer walls on the rim or hub, or both. Instead lateral containment can be achieved by other means, such as by extending interior walls into the elastomer or bladders as in FIG. 4 or by bonding the elastomer(s) or bladder(s) to interior surfaces of the rim and hub. Some examples are given below. FIG. 8 shows an embodiment in which the rim has only cap 44 and 54 and the hub has only the spindles, so that there are no outer walls. In this embodiment, there is both an interior wall 88 and 98 extending from the rim cap into the elastomer and an interior wall 28 and 38 extending from the hub spindle into the elastomer.

Figure 9:
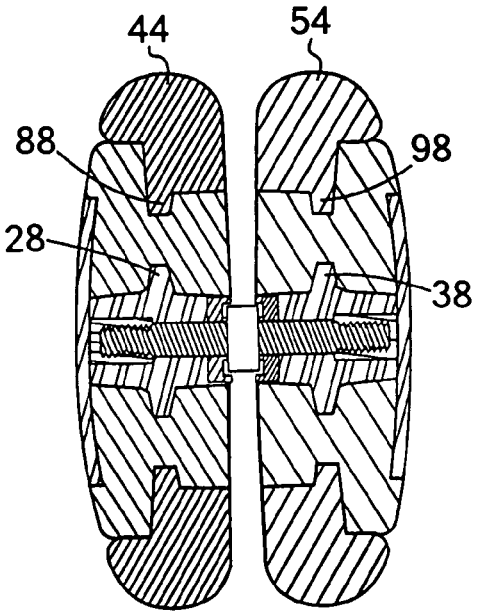
FIG. 9 shows a cross section view of an embodiment with interior walls extending into an elastomer and with a rim and a hub each having only one outer wall.
Figure 10:
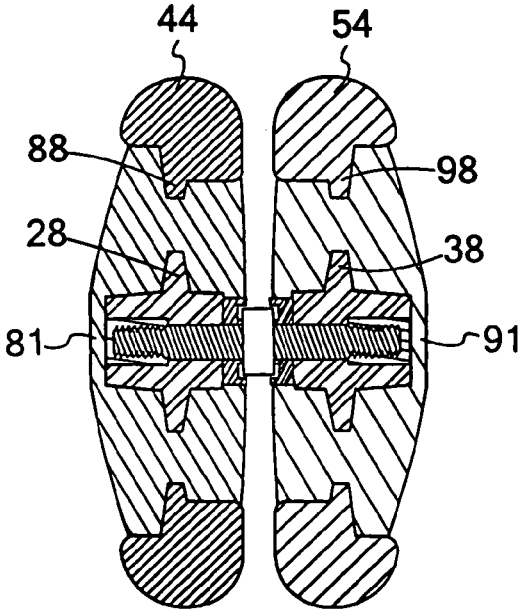
FIG. 10 shows a cross section view of an embodiment with interior walls extending into an elastomer, with a rim having only one outer wall, with a hub having no outer walls, and with elastomer extending around the outside of the hub.

FIG. 9 shows an embodiment in which the rim has only a cap 44 and 54, an outer wall adjacent to the string gap (inner section 42 and 52) and interior wall 88 and 98 extending into the elastomer. Similarly, the hub has only a spindle, an outer section, and an interior wall 28 and 38 extending into the elastomer. In this embodiment, there is exposed elastomer adjacent to the string gap that serves as a friction agent for positive yo-yo returns. FIG. 10 shows an embodiment similar to that shown in FIG. 9, except that the hub is without an outer section and elastomer 81 and 91 extends around the outside of the hub to protect it from possible damage and to enhance the grip and feel for the player.

I claim:

1. A yo-yo comprising: two half bodies separated by a string gap and attached to each other by an axle, each half body having a hub surrounding the axle, a rim made of a rigid material, wherein the hub and the rim are separated by gaps and are not in contact with each other, and flexible, compressible material occupies a cavity substantially defined by space between the hub and the rim, the flexible, compressible material being laterally contained by the rim and the hub in each half body.

2. A yo-yo as set forth in claim 1 wherein the flexible, compressible material is an elastomer.

3. A yo-yo as set forth in claim 2 wherein the elastomer contains cavities.

4. A yo-yo as set forth in claim 1 wherein the flexible, compressible material is a plurality of elastomers.

5. A yo-yo as set forth in claim 4 wherein the elastomers contain cavities.

6. A yo-yo as set forth in claim 1 further comprising a friction reduction device surrounding the axle in the string gap.

* * * * *